US012678011B2

(12) United States Patent
Seo et al.

(10) Patent No.: US 12,678,011 B2
(45) Date of Patent: Jul. 14, 2026

(54) CLEANER

(71) Applicant: LG ELECTRONICS INC., Seoul (KR)

(72) Inventors: Jonghyun Seo, Seoul (KR); Mantae Hwang, Seoul (KR); Chungjae Ryu, Seoul (KR); Jinwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 455 days.

(21) Appl. No.: 17/771,850

(22) PCT Filed: Nov. 6, 2020

(86) PCT No.: PCT/KR2020/015474
§ 371 (c)(1),
(2) Date: Apr. 26, 2022

(87) PCT Pub. No.: WO2021/091287
PCT Pub. Date: May 14, 2021

(65) Prior Publication Data
US 2022/0369889 A1 Nov. 24, 2022

(30) Foreign Application Priority Data
Nov. 7, 2019 (KR) ..... 10-2019-0141888

(51) Int. Cl.
*A47L 11/40* (2006.01)

(52) U.S. Cl.
CPC ..... *A47L 11/4038* (2013.01); *A47L 11/4044* (2013.01); *A47L 11/4069* (2013.01); *A47L 11/4094* (2013.01)

(58) Field of Classification Search
CPC ..... A47L 11/02; A47L 11/14; A47L 11/16; A47L 11/20; A47L 11/2025; A47L 11/283; A47L 11/293; A47L 11/305
(Continued)

(56) References Cited

U.S. PATENT DOCUMENTS 3,375,540 A * 4/1968 Hyde ..... A47L 11/4044 15/328
4,598,440 A 7/1986 Wilson
(Continued)

FOREIGN PATENT DOCUMENTS

JP 2006-325724 A 12/2006
KR 10-0956737 B1 5/2010
KR 10-2000068 B1 7/2019

OTHER PUBLICATIONS

Copy and Machine Translation of CN 106214076 A to Guo et al. (Year: 2016).*

(Continued)

*Primary Examiner* — Monica S Carter
*Assistant Examiner* — Jonathan R Zaworski
(74) *Attorney, Agent, or Firm* — Birch, Stewart, Kolasch & Birch, LLP

(57) ABSTRACT

A cleaner is disclosed. The cleaner according to an embodiment of the present disclosure includes a body, a rotating plate rotatably coupled to the body and including an edge portion having a predetermined height (h1) in a vertical direction, a mop coupled to a bottom surface of the rotating plate, and a blocking rib protruding downward from the body and formed along a periphery of the rotating plate, a lower end of the blocking rib being lower than an upper end of the edge portion. According to an embodiment of the present disclosure, it is possible to effectively prevent hair and the like from being introduced between the body and the rotating plate.

20 Claims, 9 Drawing Sheets

(58) Field of Classification Search
USPC ..... 15/538
See application file for complete search history.

(56) References Cited

U.S. PATENT DOCUMENTS

| | | | | |
|---|---|---|---|---|
| 4,805,256 | A * | 2/1989 | Mason | A47L 11/4061 15/385 |
| 7,412,750 | B2 * | 8/2008 | Oh | A47L 9/0472 15/375 |
| 2008/0172822 | A1 | 7/2008 | Oh et al. | |
| 2018/0235425 | A1 * | 8/2018 | Ding | A47L 11/161 |
| 2019/0328194 | A1 | 10/2019 | Kim et al. | |
| 2019/0328202 | A1 * | 10/2019 | Yang | A47L 11/4069 |

OTHER PUBLICATIONS

International Search Report, issued in PCT/KR2020/015474, dated Feb. 26, 2021.

* cited by examiner

【Figure 1】
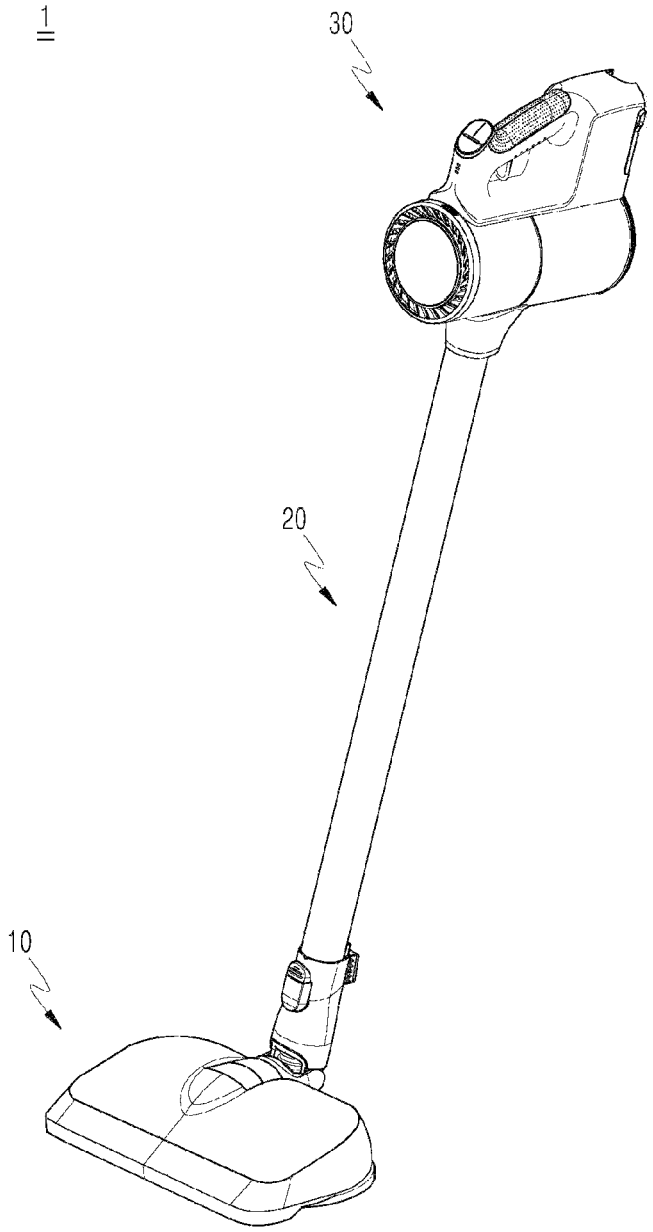

【Figure 2】
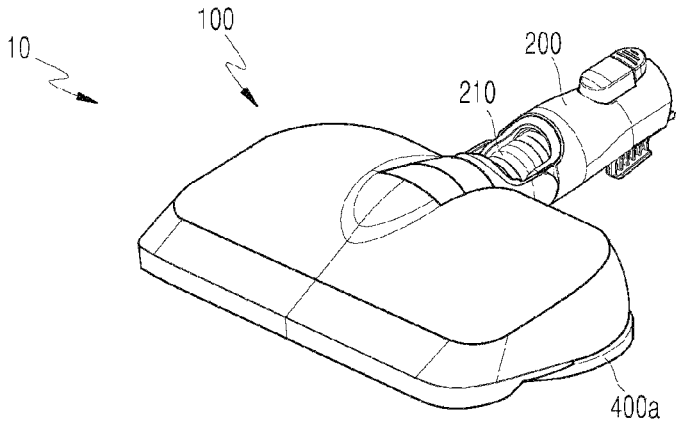

【Figure 3】
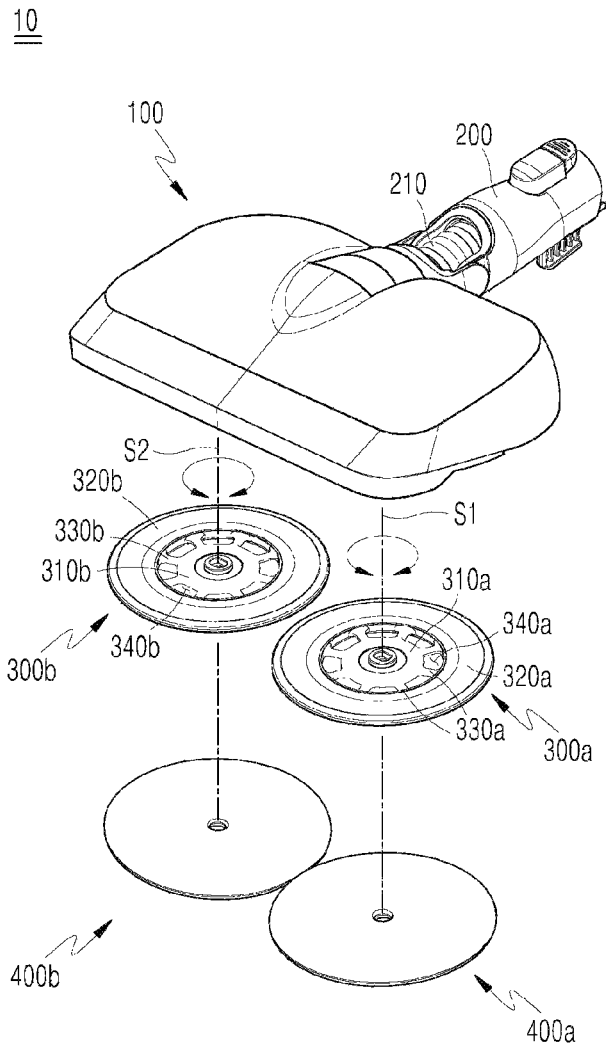

【Figure 4】
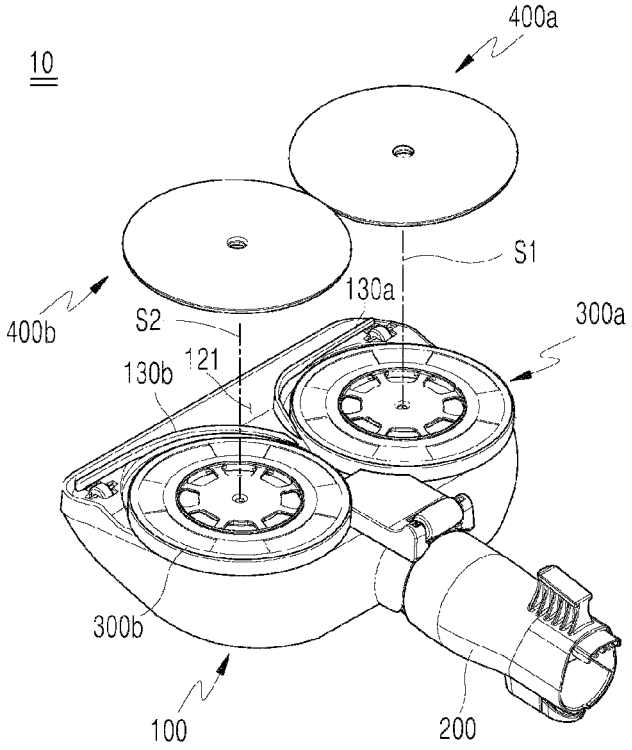

【Figure 5】
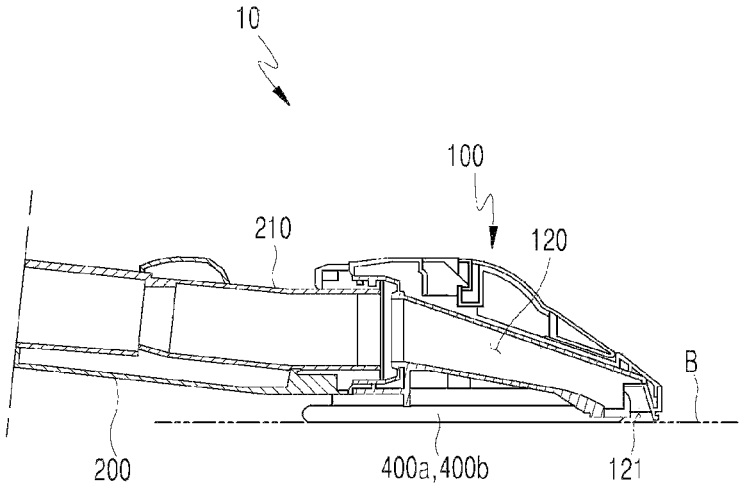
【Figure 6】
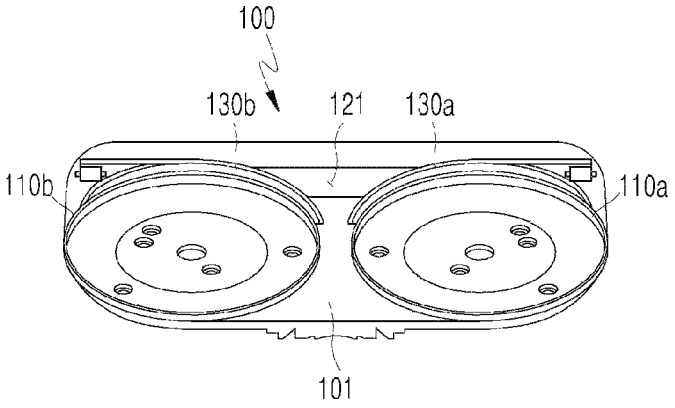

【Figure 7】
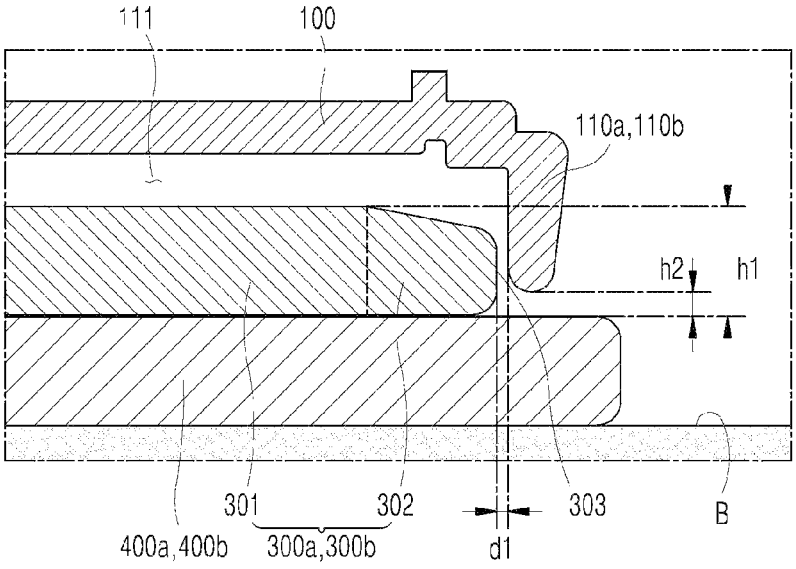
【Figure 8】
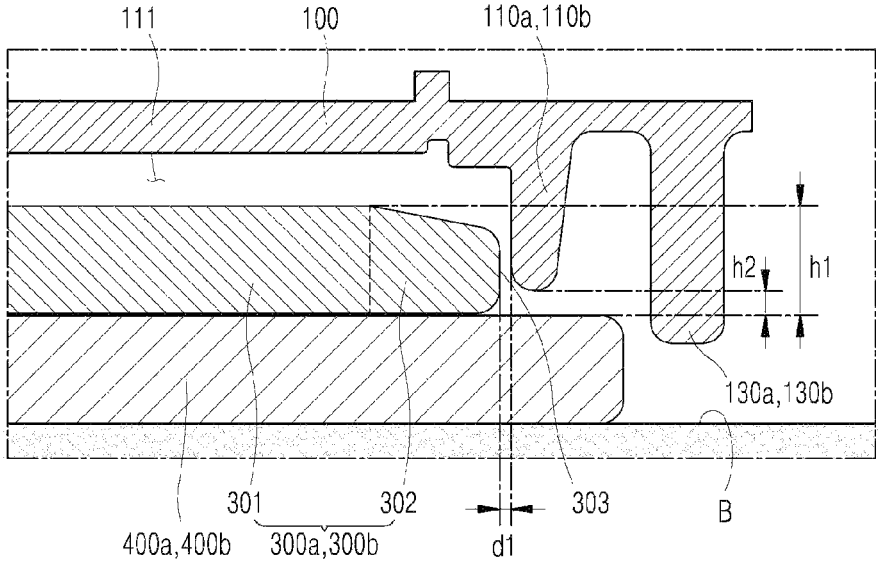

【Figure 9】
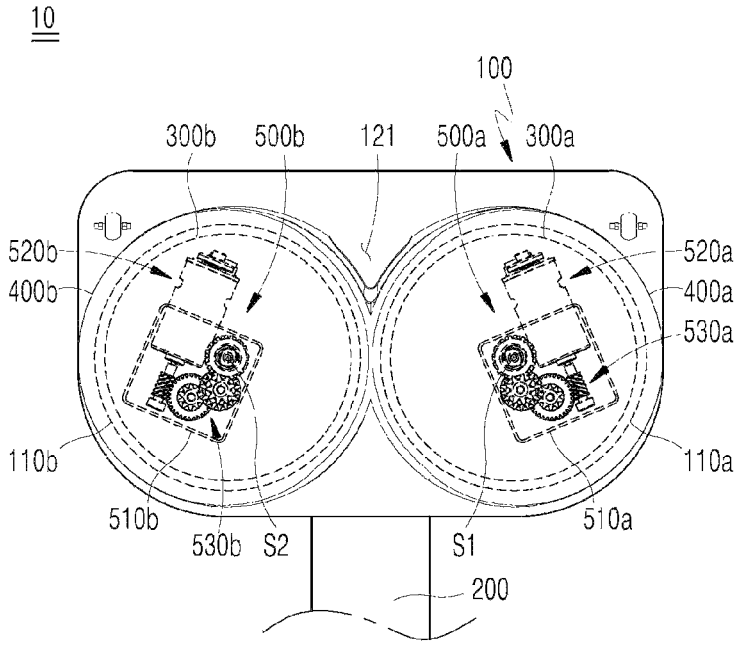
【Figure 10】
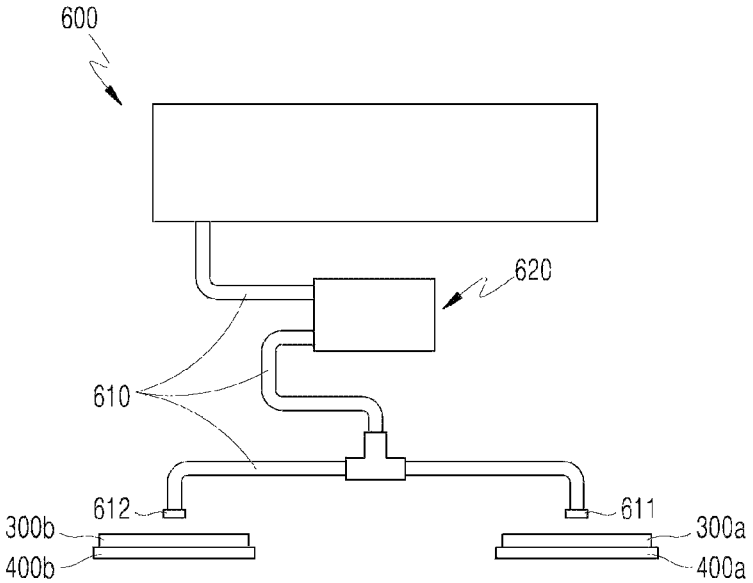

【Figure 11a】
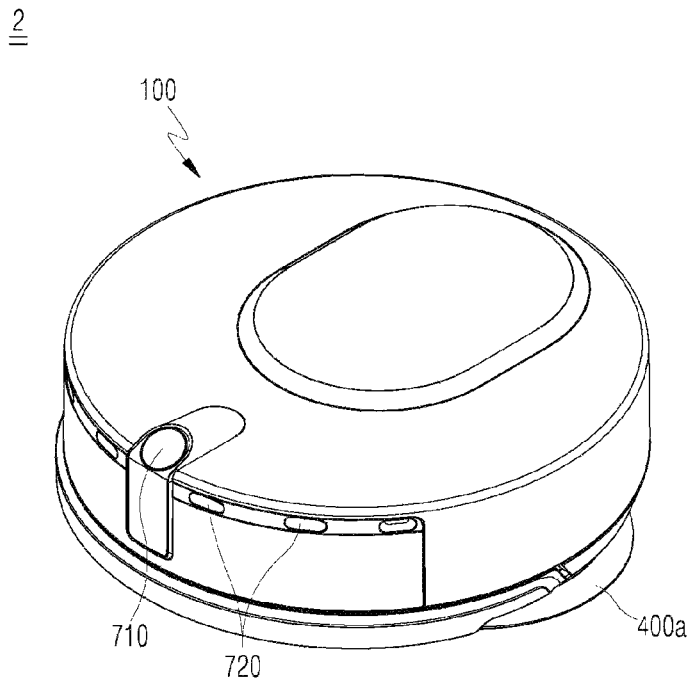

【Figure 11b】
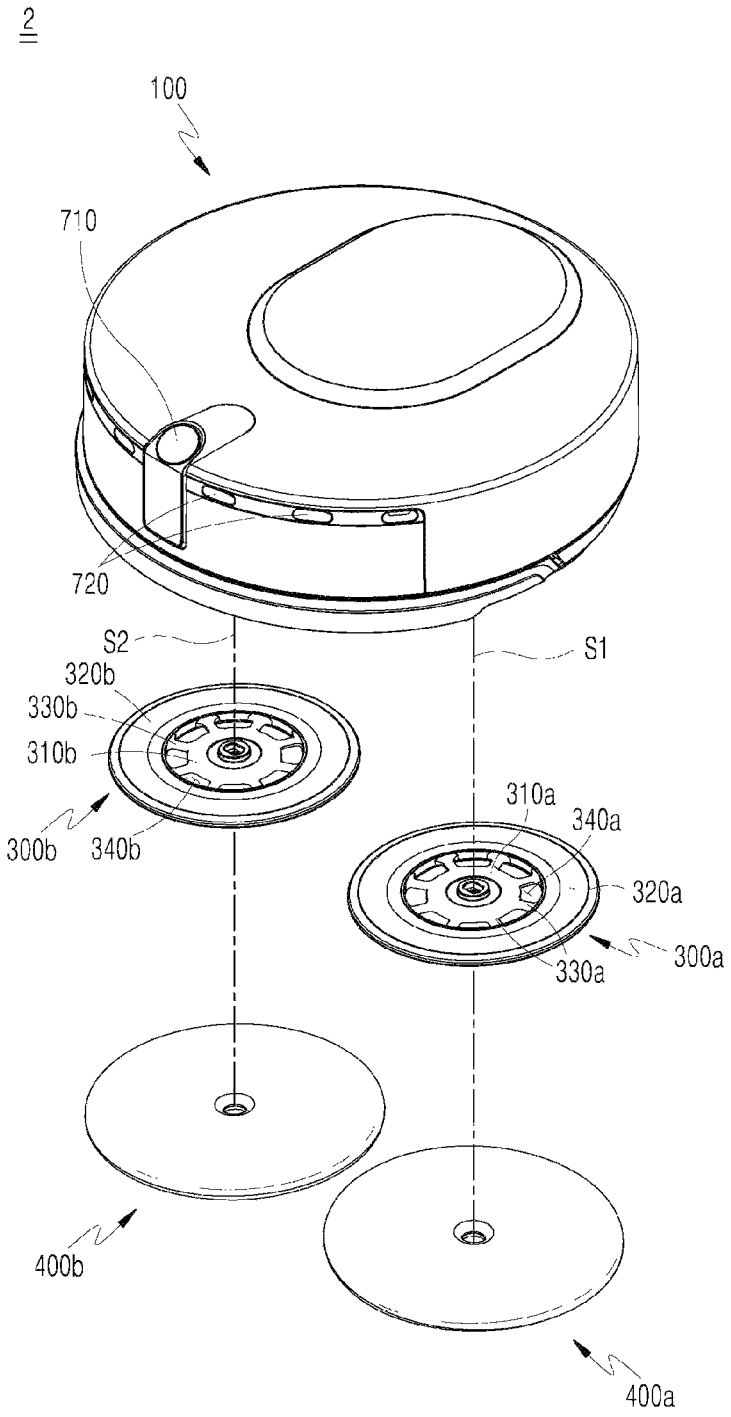

CLEANER

CROSS REFERENCE TO RELATED APPLICATIONS

This application is the National Phase of PCT International Application No. PCT/KR2020/015474, filed on Nov. 6, 2020, which claims priority under 35 U.S.C. 119(a) to Patent Application No. 10-2019-0141888, filed in the Republic of Korea on Nov. 7, 2019, all of which are hereby expressly incorporated by reference into the present application.

TECHNICAL FIELD

The present disclosure relates to a cleaner, and more particularly, to a cleaner that can perform mopping by using a mop rotating while being in contact with the floor.

BACKGROUND

A cleaner may be designed to suck dust or the like by vacuum, sweep up dust, or wipe a cleaning surface by using a mop.

A robot cleaner including motors, various sensors, and artificial intelligence (AI) may perform cleaning while moving around a cleaning target area by itself.

A cleaner is introduced which cleans the floor by performing mopping while a pair of mops facing the floor are rotating. Such a cleaner includes a body, a pair of rotating plates coupled to the bottom of the body, and mops coupled to the bottom of the rotating plates.

According to this type of cleaner, it is possible to easily remove foreign objects stuck to the floor through friction between the mops and the floor surface while the pair of rotating plates and the mops are rotating.

However, in this type of cleaner, dust, hair, or the like may be introduced between the body and the rotating plates. If this is not properly prevented, operation failure or malfunction of the cleaner may be caused.

DISCLOSURE

Technical Problem

An object of the present disclosure is to provide a cleaner including a mop that is in contact with the floor and rotates on the floor, wherein the cleaner has a means for preventing hair from being introduced between a body and a rotating plate rotating against the body.

Another object of the present disclosure is to provide a cleaner having a means for preventing the upper surface of the rotating plate from being exposed from the side.

Further another object of the present disclosure is to provide a cleaner having a means that does not interfere with the rotation of the rotating plate and the mop while preventing hair and the like from being introduced toward a rotating shaft of the rotating plate.

Technical Solution

In order to achieve the objects, a cleaner according to an embodiment of the present disclosure may include a body, a rotating plate rotatably coupled to the body and including an edge portion having a predetermined height (h1) in a predetermined vertical direction, a mop coupled to a bottom surface of the rotating plate; and a blocking rib protruding downward from the body and formed along a periphery of the rotating plate, a lower end of the blocking rib being lower than an upper end of the edge portion.

In addition, in order to achieve the objects, a cleaner according to an embodiment of the present disclosure may include a body, a blocking rib protruding downward from a bottom of the body and forming a circular wall, and a rotating plate having at least a portion located in an inner space defined by the blocking rib, rotatably coupled to the bottom of the body, and coupled to a mop at a bottom surface thereof.

The rotating plate may include an edge portion forming a side edge and spaced apart from a bottom of the body, and a lower end of the blocking rib may be lower than an upper end of the edge portion.

The edge portion and an inner circumferential surface of the blocking rib may form a concentric circle with respect to a rotating shaft of the rotating plate.

A distance between the rotating plate and the blocking rib may be 0.2 mm to 0.4 mm.

The edge portion may include an edge surface that is parallel to a rotating shaft of the rotating plate or is farther away from the rotating shaft as the edge surface faces upward, and the lower end of the blocking rib may be lower than an upper end of the edge surface.

The lower end of the blocking rib may be higher than the lower end of the edge portion, and a distance (d1) between the edge portion and the blocking rib may be less than a height difference (h2) between a lower end of the edge portion and the lower end of the blocking rib.

The height difference (h2) between the lower end of the edge portion and the lower end of the blocking rib may be 0.7 mm to 1.1 mm.

A height difference (h2) between a lower end of the edge portion and the lower end of the blocking rib may be less than ½ of a height (h1) of the edge portion.

The rotating plate, the mop, and the blocking rib may each be provided as a pair.

One pair of the rotating plates, the mops, and the blocking ribs may be symmetrical to each other.

The body may include: a suction passage provided between one pair of the rotating plates; and a suction guide wall protruding downward from a bottom surface of the body and located outside the blocking rib so as to guide the introduction of dust into the suction passage.

A lower end of the suction guide wall may be lower than the lower end of the blocking rib.

The blocking rib may be continuously formed to surround the entirety of the rotating plate.

An inner diameter of the blocking rib may be less than a diameter of the mop, and when viewed from below, the blocking rib may be shielded by the mop.

The blocking rib may be spaced apart from the mop.

The cleaner may further include an actuator coupled to the body to rotate the rotating plate.

Advantageous Effects

In a cleaner according to an embodiment of the present disclosure, a blocking rib protrudes downward from a body and is formed along the periphery of a rotating plate. A lower end of the blocking rib may be lower than an upper end of an edge portion of the rotating plate. Accordingly, since hair and the like are caught by the blocking rib during cleaning, it is possible to prevent hair and the like from being introduced into the upper side of the rotating plate.

In the cleaner according to the embodiment of the present disclosure, an interval between the edge portion and the blocking rib may be less than a height difference between the lower end of the edge portion and the lower end of the blocking rib. Accordingly, the edge portion may be rotatable without friction with the blocking rib, it is possible to prevent hair and the like from being introduced between the edge portion and the blocking rib, and it is possible to prevent friction between the mop and the blocking rib.

According to the embodiment of the present disclosure, a suction passage and a suction guide wall are formed in the body, and the lower end of the suction guide wall may be lower than the lower end of the blocking rib. Accordingly, it is possible to prevent hair and the like from moving toward the rotating plate due to the suction force acting on the suction passage and to prevent hair and the like from being introduced between the rotating plate and the body.

According to the embodiment of the present disclosure, the inner diameter of the blocking rib is less than the diameter of the mop, and the blocking rib at the bottom may be shielded by the mop. Accordingly, even if hair attached to the mop is blown by centrifugal force or the like, the hair generally collides with the outer surface of the blocking rib, thereby preventing the hair from being introduced between the blocking rib and the rotating plate.

BRIEF DESCRIPTION OF DRAWINGS

FIG. 1 is a perspective view showing a cleaner according to an embodiment of the present disclosure.

FIG. 2 is a perspective view separately showing a cleaner nozzle shown in FIG. 1.

FIG. 3 is an exploded perspective view showing the cleaner nozzle shown in FIG. 2.

FIG. 4 is a perspective view of the cleaner nozzle shown in FIG. 2 when viewed from below. In FIG. 4, a mop is shown in a separated state.

FIG. 5 is a cross-sectional view schematically showing the cleaner nozzle according to an embodiment of the present disclosure.

FIG. 6 is a perspective view of a body constituting the cleaner nozzle according to an embodiment of the present disclosure, when viewed from below.

FIG. 7 is a cross-sectional view showing a portion of a cleaner according to another embodiment of the present disclosure.

FIG. 8 is a cross-sectional view showing a portion of a cleaner according to further another embodiment of the present disclosure.

FIG. 9 is a view of a cleaner nozzle according to further another embodiment of the present disclosure, when viewed from below. In FIG. 9, an actuator, a rotating plate, and a blocking rib are indicated by dashed lines.

FIG. 10 is a view schematically showing a configuration relationship of some components constituting a cleaner according to further another embodiment of the present disclosure.

FIG. 11*a* is a perspective view showing a cleaner according to still further embodiment of the present disclosure, and FIG. 11*b* is an exploded perspective view showing the cleaner shown in FIG. 11A.

BEST MODE FOR CARRYING OUT THE INVENTION

Hereinafter, in order to explain the present disclosure in more detail, embodiments according to the present disclosure will be described in more detail with reference to the accompanying drawings. Like reference numerals denote like elements throughout the detailed description.

FIG. 1 is a perspective view showing a cleaner 1 according to an embodiment of the present disclosure, FIG. 2 is a perspective view separately showing a cleaner nozzle 10 shown in FIG. 1, FIG. 3 is an exploded perspective view showing the cleaner nozzle 10 shown in FIG. 2, FIG. 4 is a perspective view of the cleaner nozzle 10 shown in FIG. 2 when viewed from below, FIG. 5 is a cross-sectional view schematically showing the cleaner nozzle 10 according to an embodiment of the present disclosure, and FIG. 6 is a perspective view of a body 100 constituting the cleaner nozzle 10 according to an embodiment of the present disclosure, when viewed from below.

The cleaners 1 and 2 according to embodiments of the present disclosure are configured to wipe a cleaning target surface. For example, when a user wants to clean a floor surface, the user can wipe the floor surface by using the cleaners 1 and 2 according to the embodiments of the present disclosure.

In addition, the cleaner 1 according to the embodiment of the present disclosure may be configured to suck dust and the like in a cleaning target place, like a vacuum cleaner.

The cleaners 1 and 2 according to the embodiments of the present disclosure each include a body 100, rotating plates 300*a* and 300*b*, and mops 400*a* and 400*b*.

The cleaner 1 according to the embodiment of the present disclosure may include an extension pipe 20 and a handle 30. In this case, a portion provided with the body 100, the rotating plates 300*a* and 300*b*, and the mops 400*a* and 400*b* may be referred to as a 'cleaner nozzle 10'. That is, the cleaner nozzle 10 may include the body 100, the rotating plates 300*a* and 300*b*, and the mops 400*a* and 400*b* (see FIG. 3).

The extension pipe 20 may be formed in the form of a pipe.

The handle 30 may include a suction force generator (for example, a cyclone), a battery, and the like.

Dust and the like may move between the cleaner nozzle 10 and the handle 30 through the extension pipe 20, and power may be supplied through the extension pipe 20.

On the other hand, the cleaner 2 according to the embodiment of the present disclosure may be a robot cleaner. In this case, in the cleaner 2 according to the embodiment of the present disclosure, the extension pipe 20 and the handle 30 described above may not be provided (see FIGS. 11*a* and 11*b*).

When the cleaner according to the embodiment of the present disclosure is the robot cleaner 2, a battery is provided inside the body 100, and the body 100 is provided with various sensors 710 and 720 that detect surrounding obstacles, floor conditions, and the like, and a controller that collects information through the sensors and controls the battery, actuators 500*a* and 500*b*), a pump 620, and the like.

The cleaners 1 and 2 and the cleaner nozzle 10 according to the embodiments of the present disclosure may be configured to clean a cleaning target surface, and typically may be configured to clean a floor surface. Accordingly, in the following description, the vertical direction is determined based on a state in which the mops 400*a* and 400*b* are placed to face the floor surface.

When the 'lower end' of each configuration described in the embodiment of the present disclosure may be the lowest portion of each configuration or a portion closest to the floor B when the mops 400*a* and 400*b* are placed to face the floor surface in the cleaner 2 and the cleaner nozzle 10 according to the embodiment of the present disclosure.

In addition, when the 'upper end' of each configuration described in the embodiment of the present disclosure may be the highest portion of each configuration or a portion farthest from the floor B when the mops 400*a* and 400*b* are placed to face the floor surface in the cleaner 2 and the cleaner nozzle 10 according to the embodiment of the present disclosure.

The cleaner 2 according to the embodiment of the present disclosure includes the body 100, the rotating plates 300*a* and 300*b*, the mops 400*a* and 400*b*, and blocking ribs 110*a* and 110*b*.

On the other hand, the cleaner nozzle 10 according to the embodiment of the present disclosure includes the body 100, the rotating plates 300*a* and 300*b*, the mops 400*a* and 400*b*, and the blocking ribs 110*a* and 110*b*.

The body 100 may form the overall appearance of the cleaner 2 or the cleaner nozzle 10, or may have a frame shape. Each component constituting the cleaner 2 or the cleaner nozzle 10 may be coupled to the body 100, and some components constituting the cleaners 1 and 2 may be accommodated in the body 100.

In an embodiment of the present disclosure, the body 100 may be formed in a shape having a horizontal width (or diameter) greater than a vertical height.

When viewed from above or below, the body 100 may have various shapes, such as a circular shape, an elliptical shape, or a rectangular shape.

When the cleaner 1 according to the embodiment of the present disclosure includes the cleaner nozzle 10, the body 100 may form the overall appearance of the cleaner nozzle 10.

In this case, the cleaner nozzle 10 may be provided with a connection pipe 200 and a connection tube 210. In addition, the body 100 may have a suction passage 120 and suction guide walls 130*a* and 130*b* formed therein.

The connection pipe 200 is formed in the form of a pipe. The connection pipe 200 has one end portion rotatably coupled (for example, hinged) to the body 100 and the other end portion coupled to the extension pipe 20.

The connection pipe 200 may be detachably coupled to the extension pipe 20. Accordingly, the cleaner nozzle 10 may be coupled to the extension pipe 20 and may be separated from the extension pipe 20.

The connection tube 210 may be formed in the form of a flexible corrugated pipe, and is located inside the connection pipe 200. The inside of the connection tube 210 communicates with the inside of the extension pipe 20, and defines a passage through which dust introduced into the cleaner nozzle 10 moves.

The suction passage 120 may be provided inside the body 100, and the suction passage 120 defines a passage through which dust is introduced from the body 100. The inside of the suction passage 120 (an outlet of the suction passage 120) communicates with the inside of the connection tube 210. An inlet 121 of the suction passage 120 may be defined on the bottom surface of the body 100 and may be opened toward the bottom surface.

The suction guide walls 130*a* and 130*b* may be provided as a pair, and protrude downward from the bottom surface of the body 100 to form a predetermined wall. One end portion of each of the suction guide walls 130*a* and 130*b* extends toward the inlet 121 of the suction passage 120. The interval between the pair of suction guide walls 130*a* and 130*b* becomes narrower as the distance to the suction passage 120 decreases. During cleaning, dust and the like are naturally collected and introduced into the suction passage 120.

When the suction force generator (cyclone) is operated by the operation of the handle 30, the suction force at the handle 30 is transmitted to the extension pipe 20, the connection tube 210, and the suction passage 120. Accordingly, dust and the like on the floor may be introduced toward the suction passage 120.

The rotating plates 300*a* and 300*b* are made to have a predetermined area, and are formed in the form of a flat plate or a flat frame. The rotating plates 300*a* and 300*b* are generally laid down horizontally, and thus, the horizontal width (or diameter) is sufficiently greater than the vertical height. The rotating plates 300*a* and 300*b* coupled to the body 100 may be parallel to the bottom surface B, or may form an inclination with the bottom surface B.

The rotating plates 300*a* and 300*b* may have a circular plate shape, and the bottom surfaces of the rotating plates 300*a* and 300*b* may have a substantially circular shape.

The rotating plates 300*a* and 300*b* may have a rotationally symmetrical shape as a whole.

The rotating plates 300*a* and 300*b* are rotatably coupled to the body 100.

The rotating plates 300*a* and 300*b* may be rotatably coupled to the bottom surface of the body 100. As the rotating plates 300*a* and 300*b* are rotated relative to the body 100, rotating shafts S1 and S2 of the rotating plates 300*a* and 300*b* may be connected the body 100, and other portions of the rotating plates 300*a* and 300*b* except for the rotating shafts S1 and S2 may be spaced apart from the body 100. Accordingly, a predetermined interval (gap) is defined between the rotating plates 300*a* and 300*b* and the body 100.

As an example, when the bottom surface of the body 100 is generally flat in the horizontal direction, and the rotating plates 300*a* and 300*b* having a horizontally flat shape are coupled to the bottom surface 101 of the body 100, a predetermined gap is defined in the horizontal direction between the bottom surface of the body 100 and the upper surfaces of the rotating plates 300*a* and 300*b*.

The mops 400*a* and 400*b* are made so that the bottom surface facing the floor has a predetermined area, and the mops 400*a* and 400*b* are made in a flat shape. The mops 400*a* and 400*b* are formed so that the horizontal width (or diameter) is sufficiently greater than the vertical height. When the mops 400*a* and 400*b* are coupled to the body 100, the bottom surfaces of the mops 400*a* and 400*b* may be parallel to the bottom surface B, or may form an inclination with the bottom surface B.

The bottom surfaces of the mops 400*a* and 400*b* may have a substantially circular shape.

The mops 400*a* and 400*b* may have a rotationally symmetrical shape as a whole, and may have a disk shape.

The mops 400*a* and 400*b* may be made of various materials capable of wiping the floor while being in contact with the floor. To this end, the bottom surfaces of the mops 400*a* and 400*b* may be made of a woven or knitted cloth, a nonwoven fabric, and/or a brush having a predetermined area.

The diameter of the mops 400*a* and 400*b* may be greater than the diameter of the rotating plates 300*a* and 300*b*. The mops 400*a* and 400*b* and the rotating plates 300*a* and 300*b* may be coupled so that the centers of the mops 400*a* and 400*b* coincide with the centers of the rotating plates 300*a* and 300*b*. Accordingly, when viewed from the bottom, the rotating plates 300*a* and 300*b* may be covered by the mops 400*a* and 400*b*.

The mops 400*a* and 400*b* may be integrally coupled to the rotating plates 300*a* and 300*b*, or may be detachably coupled to the bottom surfaces of the rotating plates 300*a* and 300*b*.

In the cleaner 1 according to the embodiment of the present disclosure, the rotating plates 300*a* and 300*b*, the mops 400*a* and 400*b* and the blocking ribs 110*a* and 110*b* may be provided as a pair, respectively.

Accordingly, in the cleaner 2 or the cleaner nozzle 10 according to the embodiment of the present disclosure, the rotating plates 300*a* and 300*b* may include a first rotating plate 300*a* and a second rotating plate 300*b*, and the mops 400*a* and 400*b* may include a first mop 400*a* and a second mop 400*b*.

The pair of rotating plates 300*a* and 300*b*, the pair of mops 400*a* and 400*b*, and the pair of blocking ribs 110*a* and 110*b* may be formed in a symmetrical (bilaterally symmetrical) shape, respectively.

When the rotating plates 300*a* and 300*b*, the mops 400*a* and 400*b*, and the blocking ribs 110*a* and 110*b*) are provided as a pair, respectively, the suction passage 120 may be provided adjacent between the pair of rotating plates 300*a* and 300*b*.

The first rotating plate 300*a* may include a first central plate 310*a*, a first outer plate 320*a*, and a first spoke 330*a*.

The first central plate 310*a* is rotatably coupled to the body 100 while forming the center of the first rotating plate 300*a*. The first central plate 310*a* may be coupled to the lower side of the body 100, and the upper surface of the first central plate 310*a* may be coupled to the body 100 while facing the lower surface of the body 100.

The rotating shaft S1 of the first rotating plate 300*a* may be formed in a direction penetrating the center of the first central plate 310*a*. In addition, the rotating shaft S1 of the first rotating plate 300*a* may be formed in a direction perpendicular to the bottom surface B, or may form a predetermined inclination with respect to a direction perpendicular to the bottom surface B.

The first outer plate 320*a* is formed to surround the first central plate 310*a* to be spaced apart from the first central plate 310*a*.

The first spoke 330*a* connects the first central plate 310*a* to the first outer plate 320*a*. The first spoke 330*a* are provided in plurality and are repeatedly formed in the circumferential direction of the first central plate 310*a*. The first spokes 330*a* may include a plurality of holes 340*a* arranged at equal intervals and penetrating vertically between the first spokes 330*a*. A liquid (water) discharged from a nozzle 611 of a water supply tube 610 to be described below may be delivered to the first mop 400*a* through the holes 340*a*.

The bottom surface of the first rotating plate 300*a* coupled to the body 100 may form a predetermined inclination with the bottom surface B. In this case, the rotating shaft S1 of the first rotating plate 300*a* may form a predetermined inclination with respect to a direction perpendicular to the bottom surface B.

The second rotating plate 300*b* may include a second central plate 310*b*, a second outer plate 320*b*, and a second spoke 330*b*.

The second central plate 310*b* is rotatably coupled to the body 100 while forming the center of the second rotating plate 300*b*. The second central plate 310*b* may be coupled to the lower side of the body 100, and the upper surface of the second central plate 310*b* may be coupled to the body 100 while facing the lower surface of the body 100.

The rotating shaft S2 of the second rotating plate 300*b* may be formed in a direction penetrating the center of the second central plate 310*b*. In addition, the rotating shaft S2 of the second rotating plate 300*b* may be formed in a direction perpendicular to the bottom surface B, or may form a predetermined inclination with respect to a direction perpendicular to the bottom surface B.

The second outer plate 320*b* is formed to surround the second central plate 310*b* to be spaced apart from the second central plate 310*b*.

The second spoke 330*b* connects the second central plate 310*b* to the second outer plate 320*b*. The second spoke 330*b* are provided in plurality and are repeatedly formed in the circumferential direction of the second central plate 310*b*. The second spokes 330*b* may include a plurality of holes 340*b* arranged at equal intervals and penetrating vertically between the second spokes 330*b*. A liquid (water) discharged from a nozzle 612 of a water supply tube 610 to be described below may be delivered to the second mop 400*b* through the holes 340*b*.

The bottom surface of the second rotating plate 300*b* coupled to the body 100 may form a predetermined inclination with the bottom surface B. In this case, the rotating shaft S2 of the second rotating plate 300*b* may form a predetermined inclination with respect to a direction perpendicular to the bottom surface B.

The second rotating plate 300*b* may be formed in the same manner as the first rotating plate 300*a*, or may be formed symmetrically. If the first rotating plate 300*a* is located on the left side of the cleaners 1 and 2, the second rotating plate 300*b* may be located on the right side of the cleaners 1 and 2. In this case, the first rotating plate 300*a* and the second rotating plate 300*b* may be symmetrical to each other.

The first mop 400*a* is detachably attached to the bottom surface of the first rotating plate 300*a* and is coupled to the first rotating plate 300*a* to rotate together with the first rotating plate 300*a*. The first mop 400*a* may be closely coupled to the bottom surface of the first outer plate 320*a*, and may be closely coupled to the bottom surfaces of the first central plate 310*a* and the first outer plate 320*a*.

The first mop 400*a* may be detachably attached to the first rotating plate 300*a* by using various devices and methods. In one embodiment, at least a portion of the first mop 400*a* may be coupled to the first rotating plate 300*a* by hooking, fitting, or the like to the first rotating plate 300*a*. In another embodiment, a separate device such as a clamp for coupling the first mop 400*a* to the first rotating plate 300*a* may be provided. In further another embodiment, one side of a pair of fastening devices coupled to and separated from each other may be fixed to the first mop 400*a* and the other side thereof may be fixed to the first rotating plate 300*a* (as a specific example of the fastening devices, a pair of magnets that attract each other, a pair of velcros coupled to each other, or a pair of buttons (a female button and a male button) coupled to each other may be used).

When the first mop 400*a* is coupled to the first rotating plate 300*a*, the first mop 400*a* and the first rotating plate 300*a* may be coupled to each other in an overlapping form, and the first mop 400*a* may be coupled to the first rotating plate 300*a* so that the center of the first mop 400*a* coincides with the center of the first rotating plate 300*a*.

The second mop 400*b* is detachably attached to the bottom surface of the second rotating plate 300*b* and is coupled to the second rotating plate 300*b* to rotate together with the second rotating plate 300*b*. The second mop 400*b* may be closely coupled to the bottom surface of the second outer plate 320*b*, and may be closely coupled to the bottom surfaces of the second central plate 310*b* and the second outer plate 320*b*.

The second mop 400*b* may be detachably attached to the second rotating plate 300*b* by using various devices and methods. In one embodiment, at least a portion of the second mop 400*b* may be coupled to the second rotating plate 300*b* by hooking, fitting, or the like to the second rotating plate 300*b*. In another embodiment, a separate device such as a clamp for coupling the second mop 400*b* to the second rotating plate 300*b* may be provided. In further another embodiment, one side of a pair of fastening devices coupled to and separated from each other may be fixed to the second mop 400*b* and the other side thereof may be fixed to the second rotating plate 300*b* (as a specific example of the fastening devices, a pair of magnets that attract each other, a pair of velcros coupled to each other, or a pair of buttons (a female button and a male button) coupled to each other may be used).

When the second mop 400*b* is coupled to the second rotating plate 300*b*, the second mop 400*b* and the second rotating plate 300*b* may be coupled to each other in an overlapping form, and the second mop 400*b* may be coupled to the second rotating plate 300*b* so that the center of the second mop 400*b* coincides with the center of the second rotating plate 300*b*.

FIG. 7 is a cross-sectional view showing a portion of the cleaners 1 and 2 according to further another embodiment of the present disclosure, and FIG. 8 is a cross-sectional view showing a portion of the cleaners 1 and 2 according to further another embodiment of the present disclosure.

Rotating plates 300*a* and 300*b* include an edge portion 302.

The edge portion 302 is a portion forming edges of the rotating plates 300*a* and 300*b*, and is spaced apart from rotating shafts S1 and S2 of the rotating plates 300*a* and 300*b*. Accordingly, the edge portion 302 may be defined as a portion spaced apart from the rotating shafts S1 and S2 of the rotating plates 300*a* and 300*b*.

In an embodiment of the present disclosure, the edge portion 302 may be defined as a region having a predetermined width from the edge ends of the rotating plates 300*a* and 300*b*. As an example, a region having a predetermined radius from the rotating shafts S1 and S2 of the rotating plates 300*a* and 300*b* may be a central portion 301 of the rotating plates 300*a* and 300*b*, and a portion other than the central portion 301 may be the edge portion 302 of the rotating plates 300*a* and 300*b*. As another example, a region having a predetermined distance from the edges of the rotating plates 300*a* and 300*b* may be the edge portion 302 of the rotating plates 300*a* and 300*b*.

In an embodiment of the present disclosure, the edge portion 302 may be defined as an edge end portion of the rotating plate 300*a* and 300*b*.

The edge portion 302 includes an edge surface 303, and the edge surface 303 forms a surface of the edge of the rotating plates 300*a* and 300*b*. The edge surface 303 may be a surface exposed when the rotating plates 300*a* and 300*b* are separated from the body 100 and viewed from the side.

All or part of the edge surface 303 may be made in the form of a plane parallel to the rotating shafts S1 and S2, or may be made in the form of a (flat or curved) surface inclined to the rotating shafts S1 and S2.

In addition, the edge surface 303 may be formed in the form of a surface that is farther away from the rotating shafts S1 and S2 as a part or all of the edge surface is toward the upper side.

In an embodiment of the present disclosure, the rotating plates 300*a* and 300*b* may have a predetermined thickness.

In an embodiment of the present disclosure, the edge portion 302 may have a predetermined thickness, or may have a predetermined height (thickness) h1.

In the cleaner 1 and the nozzle of the cleaner 1 according to the embodiment of the present disclosure, the blocking ribs 110*a* and 110*b* are formed in the body 100.

The blocking ribs 110*a* and 110*b* protrude downward from the body 100 and are formed along the periphery of the rotating plates 300*a* and 300*b*.

The blocking ribs 110*a* and 110*b* may be formed to protrude downward from the bottom surface of the body 100. The blocking ribs 110*a* and 110*b* may protrude downward from the bottom surface of the body 100 to form a circular wall-like shape. That is, the blocking ribs 110*a* and 110*b* may be continuously formed to surround the entirety of the rotating plates 300*a* and 300*b*.

The inner diameter of the blocking ribs 110*a* and 110*b* may be greater than the diameter of the rotating plates 300*a* and 300*b* and less than the diameter of the mops 400*a* and 400*b*.

At least a portion of the rotating plates 300*a* and 300*b* is located in an inner space 111 defined by the blocking ribs 110*a* and 110*b*.

In the cleaner 2 and the cleaner nozzle 10 according to the embodiment of the present disclosure, the blocking ribs 110*a* and 110*b* may be formed in a rotationally symmetrical shape with respect to the rotating shafts S1 and S2 of the rotating plates 300*a* and 300*b*.

In the cleaner 2 and the cleaner nozzle 10 according to the embodiment of the present disclosure, the lower ends of the blocking ribs 110*a* and 110*b* are lower than the upper ends of the edge portions 302 of the rotating plates 300*a* and 300*b*. The lower ends of the blocking ribs 110*a* and 110*b* may be lower than the upper ends of the edge surface 303.

In the cleaner 2 and the cleaner nozzle 10 according to the embodiment of the present disclosure, the edges of the rotating plates 300*a* and 300*b* and the inner circumferential surfaces of the blocking ribs 110*a* and 110*b* may form a concentric circle with each other about the rotating shafts S1 and S2 of the rotating plates 300*a* and 300*b*. The edge surface 303 and the inner circumferential surfaces of the blocking ribs 110*a* and 110*b* may form a concentric circle with each other about the rotating shafts S1 and S2 of the rotating plates 300*a* and 300*b*.

The lower ends of the blocking ribs 110*a* and 110*b* may be higher than the lower ends of the edge portion 302.

A distance d1 between the edge portion 302 and the blocking ribs 110*a* and 110*b* may be less than a height difference h2 between the lower end of the edge portion 302 and the lower end of the blocking ribs 110*a* and 110*b*.

A height difference h2 between the lower end of the edge portion 302 and the lower end of the blocking ribs 110*a* and 110*b* may be less than ½ of the height (thickness) h1 of the edge portion 302.

In a specific embodiment, the distance d1 between the rotating plates 300*a* and 300*b* and the blocking ribs 110*a* and 110*b* may be 0.2 mm to 0.4 mm. In an embodiment, the distance between the rotating plates 300*a* and 300*b* and the blocking ribs 110*a* and 110*b* may be 0.3 mm.

In a specific embodiment, the height difference h2 between the lower end of the edge portion 302 and the lower end of the blocking ribs 110*a* and 110*b* may be 0.7 mm to 1.1 mm. In an embodiment, the height difference h2 between the lower end of the edge portion 302 and the lower end of the blocking ribs 110*a* and 110*b* may be 0.7 mm to 0.9 mm.

As described above, the blocking ribs 110*a* and 110*b* may protrude downward from the body 100 and may be formed along the periphery of the rotating plates 300*a* and 300*b*, and the lower end thereof may be lower than the upper ends of the edge portions 302 of the rotating plates 300*a* and 300*b*. Accordingly, during cleaning, hair and the like are caught on the blocking ribs 110*a* and 110*b*, thereby preventing hair and the like from being introduced into the upper side of the rotating plates 300*a* and 300*b* or from being introduced into the gap between the rotating plates 300*a* and 300*b* and the body 100.

The distance between the edge portion 302 and the blocking ribs 110*a* and 110*b* may be less than the height difference between the lower end of the edge portion 302 and the lower end of the blocking ribs 110*a* and 110*b*. Accordingly, the edge portion 302 may rotate without friction with the blocking ribs 110*a* and 110*b*, it is possible to prevent hair and the like from being introduced between the edge portion 302 and the blocking ribs 110*a* and 110*b*, and it is possible to prevent friction between the mops 400*a* and 400*b* and the blocking ribs 110*a* and 110*b*.

In addition, the edge surface 303 may be formed in the form of an inclined surface that is farther away from the rotating shaft as all or part of the edge surface 303 faces upward. Accordingly, it is possible to more effectively prevent hair and the like from being introduced into the gap between the rotating plates 300*a* and 300*b* and the body 100.

In the cleaner 2 and the cleaner nozzle 10 according to the embodiment of the present disclosure, the lower ends of the suction guide walls 130*a* and 130*b* may be lower than the lower ends of the blocking ribs 110*a* and 110*b*.

Accordingly, when hair and the like are sucked into the suction passage 120 by the suction force acting on the suction passage 120, it is possible to prevent hair and the like from moving toward the rotating plates 300*a* and 300*b* and to prevent hair and the like from being introduced between the rotating plates 300*a* and 300*b* and the body 100.

According to an embodiment of the present disclosure, the inner diameter of the blocking ribs 110*a* and 110*b* is less than the diameter of the mops 400*a* and 400*b*. When viewed from below, the blocking ribs 110*a* and 110*b* may be shielded by the mops 400*a* and 400*b*. Accordingly, even if hair attached to the mops 400*a* and 400*b* is blown by centrifugal force and the like, hair generally collides with the outer surfaces of the blocking ribs 110*a* and 110*b*, thereby preventing hair from being introduced between the blocking ribs 110*a* and 110*b* and the rotating plates 300*a* and 300*b*.

FIG. 9 is a view of a cleaner nozzle 10 according to further another embodiment of the present disclosure, when viewed from below, and FIG. 10 is a view schematically showing a configuration relationship of some components constituting a cleaner 1 according to further another embodiment of the present disclosure.

The cleaner 2 and the cleaner nozzle 10 according to the embodiment of the present disclosure may include actuators 500*a* and 500*b*. The actuators 500*a* and 500*b* are coupled to the body 100 to rotate rotating plates 300*a* and 300*b*.

In the vacuum cleaner 2 and the cleaner nozzle 10 according to the embodiment of the present disclosure, when the rotating plates 300*a* and 300*b* and mops 400*a* and 400*b* are formed as a pair, the actuators 500*a* and 500*b* are also formed as a pair. Accordingly, the cleaner 2 and the cleaner nozzle 10 according to the embodiment of the present disclosure may include a first actuator 500*a* and a second actuator 500*b*.

In addition, the cleaner 2 and the cleaner nozzle 10 according to the embodiment of the present disclosure may include a water tank 600 and a water supply tube 610.

The first actuator 500*a* is coupled to the body 100 to rotate the first rotating plate 300*a*.

The first actuator 500*a* may include a first case 510*a*, a first motor 520*a*, and one or more first gears 530*a*.

The first case 510*a* supports the components constituting the first actuator 500*a* and is fixedly coupled to the body 100.

The first motor 520*a* may be an electric motor.

A plurality of first gears 530*a* rotate in engagement with each other, couples the first motor 520*a* to the first rotating plate 300*a*, and transmits the rotational power of the first motor 520*a* to the first rotating plate 300*a*. Accordingly, when a rotating shaft of the first motor 520*a* rotates, the first rotating plate 300*a* rotates.

The second actuator 500*b* is coupled to the body 100 to rotate the second rotating plate 300*b*.

The second actuator 500*b* may include a second case 510*b*, a second motor 520*b*, and one or more second gears 530*b*.

The second case 510*b* supports the components constituting the second actuator 500*b* and is fixedly coupled to the body 100.

The second motor 520*b* may be an electric motor.

A plurality of second gears 530*b* rotate in engagement with each other, couples the second motor 520*b* to the second rotating plate 300*b*, and transmits the rotational power of the second motor 520*b* to the second rotating plate 300*b*. Accordingly, when a rotating shaft of the second motor 520*b* rotates, the second rotating plate 300*b* rotates.

As such, in the cleaners 1 and 2 according to the embodiments of the present disclosure, the first rotating plate 300*a* and the first mop 400*a* may be rotated by the operation of the first actuator 500*a*, and the second rotating plate 300*b* and the second mop 400*b* may be rotated by the operation of the second actuator 500*b*.

The second actuator 500*b* may form a (bilateral) symmetry with the first actuator 500*a*.

The water tank 600 is made in the form of a container having an inner space so that a liquid such as water is stored therein. The water tank 600 may be fixedly coupled to the body 100, or may be detachably coupled to the body 100.

The water supply tube 610 is made in the form of a tube or a pipe, and is connected to the water tank 600 so that a liquid inside the water tank 600 flows through the inside. The water supply tube 610 is made such that the nozzles 611 and 612 forming the opposite end connected to the water tank 600 are located above the first rotating plate 300*a* and the second rotating plate 300*b*. Accordingly, the liquid inside the water tank 600 may be supplied to the first mop 400*a* and the second mop 400*b*.

In the cleaners 1 and 2 according to the embodiments of the present disclosure, the water supply tube 610 may be formed so that one tube is branched into two tubes. In this case, the nozzle 611 forming one end of the branched water supply tube 610 is located above the first rotating plate 300*a*, and the nozzle 612 forming the other end of the branched water supply tube 610 may be located above the second rotating plate 300*b*.

In the cleaners 1 and 2 according to the embodiments of the present disclosure, a pump 620 may be provided so as to move the liquid through the water supply tube 610.

FIG. 11*a* is a perspective view showing a cleaner 2 according to still further embodiment of the present disclosure, and FIG. 11*b* is an exploded perspective view showing the cleaner 2 shown in FIG. 11A.

As shown in FIGS. 11*a* and 11*b*, the cleaner 2 according to the embodiment of the present disclosure may be formed in the form of a robot cleaner, may include the body 100, the rotating plates 300*a* and 300*b*, and the mops 400*a* and 400*b* described above, and may further include the suction passage 120, the suction guide walls 130*a* and 130*b*, and the blocking ribs 110*a* and 110*b* described above.

The invention claimed is:

1. A cleaner comprising:

a body having a suction passage through which dust is introduced;

a rotating plate rotatably coupled to the body and including an edge portion having a predetermined height (h1) in a vertical direction;

a mop coupled to a bottom surface of the rotating plate;

a blocking rib protruding downward from the body to surround the edge portion in a radial direction of a rotating shaft of the rotating plate, at least a portion of the blocking rib being disposed between an inlet of the suction passage and the edge portion; and a suction guide wall protruding downward from the body to surround the portion of the blocking rib in the radial direction, the suction guide wall being disposed between the inlet of the suction passage and the portion of the blocking rib, wherein a lower end of the blocking rib is lower than an upper end of the edge portion and is higher than a lower end of the edge portion, and wherein a minimum distance (d1) between the edge portion and the blocking rib is less than a height difference (h2) between the lower end of the edge portion and the lower end of the blocking rib.

2. The cleaner of claim 1, wherein at least a portion of the rotating plate is located in an inner space defined by the blocking rib.

3. The cleaner of claim 2, wherein the edge portion is spaced apart from a bottom surface of the body.

4. The cleaner of claim 1, wherein the edge portion of the rotating plate and an inner circumferential surface of the blocking rib are arranged to form concentric circles with respect to the rotating shaft of the rotating plate.

5. The cleaner of claim 4, wherein a distance between the rotating plate and the blocking rib is 0.2 mm to 0.4 mm.

6. The cleaner of claim 1, wherein the edge portion includes an edge surface which is a furthest surface of the edge portion from the rotating shaft and which extends upwardly, wherein an inner circumferential surface of the blocking rib and the edge surface are arranged to face each other, and wherein the inner circumferential surface of the blocking rib is arranged to be radially spaced from the edge surface.

7. The cleaner of claim 1, wherein the lower end of the blocking rib is higher than an upper end of the mop, and wherein a lower end of the suction guide wall is lower than the lower end of the blocking rib and is lower than the upper end of the mop in a state in which the mop is coupled to the rotating plate.

8. The cleaner of claim 7, wherein the height difference (h2) between the lower end of the edge portion and the lower end of the blocking rib is 0.7 mm to 1.1 mm.

9. The cleaner of claim 1, wherein the height difference (h2) between the lower end of the edge portion and the lower end of the blocking rib is less than ½ of the predetermined height (h1) of the edge portion.

10. The cleaner of claim 1, wherein the rotating plate, the mop, and the blocking rib are each provided as a pair.

11. The cleaner of claim 10, wherein the pair of the rotating plates, the mops, and the blocking ribs are symmetrical to each other.

12. The cleaner of claim 1, wherein a lower end of the suction guide wall is lower than the lower end of the edge portion, and wherein the lower end of the edge portion is positioned radially inward from an area defined by the lower end of the blocking rib.

13. The cleaner of claim 1, wherein an inner diameter of the blocking rib is less than a diameter of the mop, and wherein, when viewed from below, the blocking rib is shielded by the mop.

14. The cleaner of claim 1, further comprising an actuator coupled to the body to rotate the rotating plate.

15. The cleaner of claim 6, wherein the edge surface is disposed to have an inclined surface with respect to the rotating shaft.

16. The cleaner of claim 10, wherein the edge portion, the blocking rib and the suction guide wall are sequentially arranged away from each other in the radial direction around the rotating shaft.

17. The cleaner of claim 1, wherein the suction guide wall is provided as a pair, and wherein an interval between the pair of suction guide walls becomes narrower as a distance to the suction passage decreases.

18. The cleaner of claim 10, wherein a diameter of the mop is smaller than an inner diameter of the suction guide wall and larger than an outer diameter of the blocking rib.

19. The cleaner of claim 1, wherein the inlet of the suction passage is disposed at a front portion of a bottom of the body and extends in a lateral direction of the body, wherein the suction guide wall is disposed behind the inlet of the suction passage, and wherein the blocking rib is disposed behind the suction guide wall.

20. The cleaner of claim 1, wherein a radius of the edge portion from the rotating shaft is smaller than a radius of the blocking rib from the rotating shaft.

* * * * *